United States Patent [19]

Nilssen

[11] Patent Number: 4,603,281

[45] Date of Patent: Jul. 29, 1986

[54] ELECTRONIC FLUORESCENT LAMP STARTER

[76] Inventor: Ole K. Nilssen, Caesar Dr., R.R.-5, Barrington, Ill. 60010

[21] Appl. No.: 560,457

[22] Filed: Dec. 12, 1983

[51] Int. Cl.[4] ..... H05B 41/14

[52] U.S. Cl. ..... 315/106; 315/107; 315/306; 315/310; 315/DIG. 5; 361/106

[58] Field of Search ..... 315/106, 107, 60, 100, 315/116, DIG. 5, 224, 306, 310; 361/105, 106

[56] References Cited

U.S. PATENT DOCUMENTS

| | | | |
|---|---|---|---|
| 4,017,761 | 4/1977 | Woldring | 315/DIG. 5 X |
| 4,068,281 | 1/1978 | Harnden, Jr. | 361/106 |
| 4,350,929 | 9/1982 | Katoogi | 315/DIG. 5 X |
| 4,399,391 | 8/1983 | Hammer et al. | 315/106 X |

FOREIGN PATENT DOCUMENTS

| | | | |
|---|---|---|---|
| 1144401 | 2/1963 | Fed. Rep. of Germany | 315/106 |

*Primary Examiner*—David K. Moore
*Assistant Examiner*—Vincent DeLuca

[57] ABSTRACT

A Varistor (which is a non-linear impedance means) is connected in series with the primary winding of a current-transformer; and this series-combination is connected across the fluorescent lamp to be started. Before the lamp starts, the voltage across it is limited in magnitude by the voltage-clamping effect of the Varistor; and the current then flowing through the Varistor is transformed by the current-transformer and applied by way of separate secondary windings to each of the lamp's cathodes for heating thereof. A special high-voltage tertiary winding on the current-transformer provides for lamp starting aid voltage.

Thus, the lamp may be gently and rapidly started in the Rapid-Start mode.

However, as soon as the lamp starts, the voltage across the lamp diminishes to a magnitude lower than that required for current to flow through the Varistor. Thus, as soon as the lamp has started, the power for heating the cathodes is removed; which thereby provides for the higher efficiency lamp operation normally associated with the Pre-Heat mode.

To prevent damage to the Varistor, which might occur if power is applied to a non-operative lamp, or while there is no lamp connected, a thermally responsive latching circuit breaker is thermally connected with the Varistor and arranged to disconnect power as soon as the temperature on the Varistor exceeds a pre-determined acceptable level.

The voltage-clamping characteristics of the Varistor are so chosen as to limit the lamp starting voltage to a magnitude suitable for effective lamp starting.

17 Claims, 1 Drawing Figure

ELECTRONIC FLUORESCENT LAMP STARTER

BACKGROUND OF THE INVENTION

1. Field of Invention

The present invention relates to starting aid means for fluorescent lamps, more particularly to electronic fluorescent lamp starters.

2. Description of Prior Art

Fluorescent lamps of the type commonly referred to as Pre-Heat fluorescent lamps normally require some form of starting aid means in order to be properly initiated into operation. The type of starting aid means most commonly used for such Pre-Heat fluorescent lamps is the so-called glow-switch or glow-tube starter as used in conjunction with a simple reactor ballast.

While the glow-tube starter has the advantages of being widely used and low in cost, it has several significant disadvantages, such as: (i) inconsistent performance, in that it is often necessary for the starter to perform several starting cycles in order to get the lamp starter—with the result of annoying lamp blinking and starting delay; (ii) relatively short life expectancy, which implies that the glow-tube starter can not prudently be provided as a permanently built-in part of the ballast, nor as a permanently wired-in part of a lighting fixture; and (iii) non-conductive to long lamp life, which is partly due to the fact that the lamp starting voltage generated by the starter (with help of the reactor ballast), upon opening of its contacts, is (in order to have at least a reasonably good probability of providing adequate starting voltage even when contact-opening occurs at a non-optimum point in time) frequently excessively high, thereby producing excessive cathode wear and correspondingly shorter lamp life.

Aside from the glow-tube lamp starter, there are several other non-electronic lamp starters described in prior art literature, such as in General Electric's Bulletin L.D. 1 issued in January, 1956; and, there is also a number of electronic lamp starters described in prior art—such as for instance in the following U.S. Pat. Nos.: No. 3,701,925 to Nozawa et al; No. 3,818,268 to Peltz; No. 3,942,069 to Kaneda; and No. 4,119,887 to Iyama et al.

However, none of these various lamp starters appear to offer cost-effective solutions to the various disadvantages described above in connection with the regular glow-tube starter.

SUMMARY OF THE INVENTION

Objects of the Invention

An initial object of the present invention is that of providing an improved starting aid means for fluorescent lamps.

A second object is that of providing a starting aid means that permits a fluorescent lamp to be started in the Rapid-Start mode and subsequently operated in the Pre-Heat mode.

A third object is that of providing an electronic fluorescent lamp starter means that is reliable and has a long operating life expectancy.

A fourth object is that of providing a fluorescent lamp starting aid means that is conducive to providing long lamp life.

A fifth object is that of providing a fluorescent lamp starting aid means that is particularly suitable for high frequency operation.

A sixth object is that of providing a fluorescent lamp starting aid means that exhibits manifest limitation on the magnitude of the starting voltage provided to the fluorescent lamp.

These as well as other objects, features and advantages of the present invention will become apparent from the following description and claims.

Brief Description

In the preferred embodiment, a Varistor (which is a non-linear impedance means) is connected in series with the primary winding of a current-transformer; and this series-combination is connected across the fluorescent lamp to be starter. Before the lamp starts, the voltage across it is limited in magnitude by the voltage-clamping effect of the Varistor; and the current then flowing through the Varistor is transformed by the current-transformer and applied by way of separate secondary windings to each of the lamp's cathodes for heating thereof. A special high-voltage tertiary winding on the current-transformer provides for lamp starting aid voltage.

Thus, the lamp may be gently and rapidly started in the Rapid-Start mode.

However, as soon as the lamp starts, the voltage across the lamp diminishes to a magnitude lower than that required for current to flow through the Varistor. Thus, as soon as the lamp has started, the power for heating the cathodes is removed; which thereby provides for the higher efficiency lamp operation normally associated with the Pre-Heat mode.

To prevent damage to the Varistor, which might occur if power is applied to an non-operative lamp, or while there is no lamp connected, a thermally responsive latching circuit breaker is thermally connected with the Varistor and arranged to disconnect power as soon as the temperature on the Varistor exceeds a predetermined acceptable level.

The voltage-clamping characteristics of the Varistor are so chosen as to limit the lamp starting voltage to a magnitude suitable for effective lamp starting.

DESCRIPTION OF THE PREFERRED EMBODIMENT

Description of the Drawings

Figure 1:
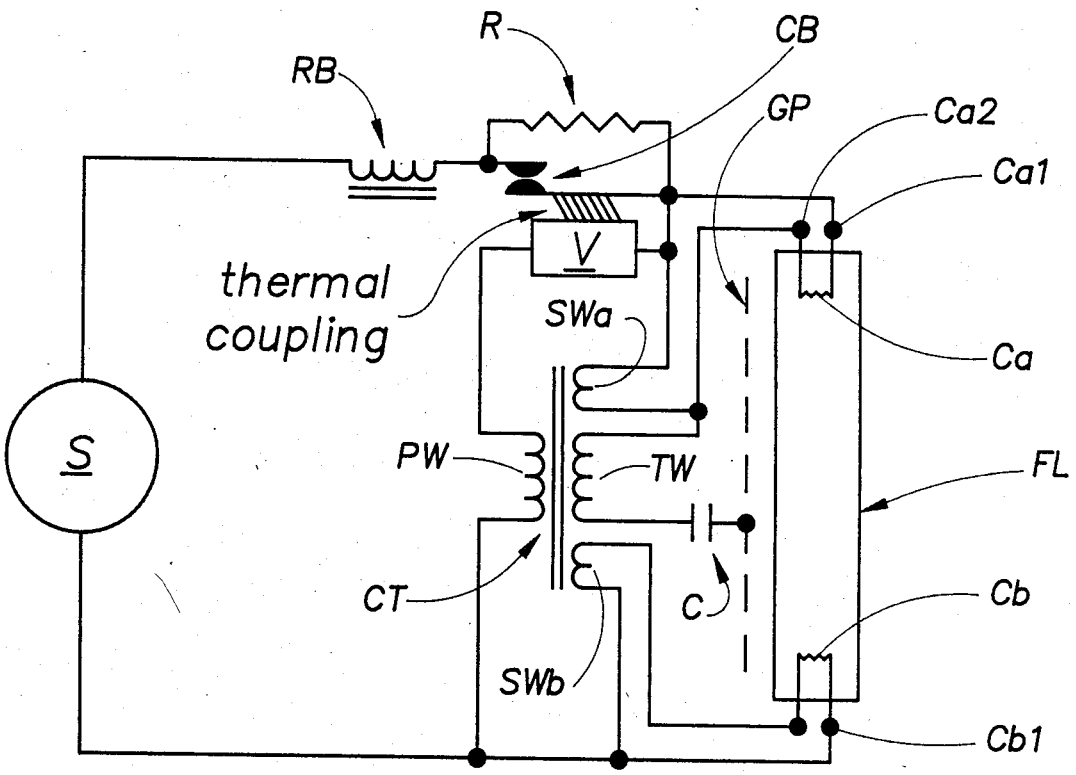
FIG. 1 diagrammatically illustrates the present invention, showing the preferred embodiment of the electronic fluorescent lamp starter as used in a simple high-frequency ballasting arrangement.

In FIG. 1, a source S provides a voltage of about 300 Volt RMS at a frequency of about 30 kHz. By way of a simple reactor ballast RB and a normally-closed thermally activated circuit breaker CB, this voltage is applied between terminals Cal and Cbl of the two thermionic cathodes Ca and Cb of a fluorescent lamp FL.

Connected in series between terminals Cal and Cbl is a Varistor V and the primary winding PW of a current transformer CT. Transformer CT has two secondary windings SWa and SWb, which respectively are connected with cathodes Ca and Cb. Transformer CT also has a tertiary winding TW, the output of which is connected by way of a capacitor C between terminal Ca2 of cathode Ca and a starting aid electrode or ground plane GP.

Circuit breaker CB is normally closed and is thermally connected in close contact with the Varistor. A resistor R is connected directly across the terminals of circuit breaker CB.

Values and/or descriptions of the various parts of the circuit of FIG. 1 are listed as follows:

Output of Source S: 300 Volt/30 kHz;
Inductance of RB: 4.3 milliHenry;
Fluorescent Lamp FL: F40/T12/CW/RS;
Varistor V: 140 Joule/225 Volt;
Capacitor C: 270 pF/630 Volt;
Resistor R: 100 kOhm/1 Watt;
Current Transformer CT: Primary winding wound with 20 turns of #32 wire on Ferroxcube 1811 Pot Core of 3C8 Material; Each secondary winding wound with 5 turns of #30 wire; Tertiary winding wound with 200 turns of #36 wire.

Description of Operation

The operation of the circuit of FIG. 1 may be explained as follows.

In FIG. 1, the 300 Volt/30 kHz voltage from source S is applied through reactor ballast RB and circuit breaker CB across the two cathodes of the fluorescent lamp and also across the series-combination of the Varistor and the primary winding PW of current transformer CT.

The voltage across the fluorescent lamp is initially limited by the Varistor to about 225 Volt RMS. The current resulting through the Varistor under this condition is about 250 milliAmp; which is mainly determined by the approximately 800 Ohm impedance of the reactor ballast.

With 250 milliAmp flowing in the transformer primary winding, the resulting currents in the two secondary windings will each be about 500 milliAmp; which is therefore the initial magnitude of the cathode heating current.

As the cathodes gradually increase in temperature, their resistance increases—from about 0.3 Ohm when they are cold to about 3.0 Ohm when they have reached incandescence. Initially, the cathode voltages resulting from the 0.3 Ohm cathode resistance have negligible effect on the magnitude of the voltage developed across the series-combination of the Varistor and the transformer primary winding: adding only about 1 Volt to the 225 Volt clamping voltage of the Varistor. After the cathodes have reached incandescence, however, the cathode voltages will add a more substantial amount: about 10 Volt RMS.

At the time the cathodes have reached incandescence, the voltage across each cathode is about 6 Volt RMS; which corresponds to 1.2 Volt per turn on the transformer. Thus, the tertiary winding will at that point provide a voltage output of 240 Volt. Since this voltage is added between one of the cathodes and the ground plane, which is located close to the lamp, the resulting extra voltage then established between the "hottest" lamp cathode and the ground plane will be effective in aiding initial lamp ionization and thereby lamp starting.

As soon as the cathodes have reached incandescence, the fluorescent lamp will start; and it will start in the Rapid-Start mode, which implies a much more gentle starting than that resulting by way of the conventional Pre-Heat starting mode.

The moment the fluorescent lamp starts, the voltage between its cathodes drops to about 100 Volt RMS; which is too low of a magnitude to cause any current to flow through the Varistor. Thus, as soon as the lamp starts, the flow of externally supplied cathode heating power ceases—just as in the case of the Pre-Heat mode.

In other words, after having been started in the Rapid-Start mode, the lamp then proceeds to operate in the Pre-Heat mode—thereby achieving a significant improvement in the overall lamp operating efficacy as compared with the Rapid-Start mode.

The power dissipation in the Varistor during the brief period before the lamp starts will be quite high, being about 56 Watt with the component values indicated for FIG. 1. This power level can be handled by the Varistor for a couple of seconds, which is long enough for the lamp to start. However, if this level of power dissipation is provided to the Varistor for much longer than a couple of seconds—which may happen in case of a non-operative or non-present lamp—the Varistor is apt to become permanently damaged.

To prevent such possible damage to the Varistor, and also not to waste energy, the circuit breaker will act to stop the flow of power to the Varistor before the Varistor's temperature reaches a destructive level. That is, the thermally responsive circuit breaker is arranged to respond to the temperature of the Varistor, and to stop the flow of power to the Varistor before it becomes damaged.

After the circuit breaker opens, a small amount of power is still flowing to the Varistor by way of resistor R—its purpose being that of keeping the Varistor temperature high enough to prevent the circuit breaker from re-closing.

In respect to the arrangement of FIG. 1, it is noted that subject fluorescent lamp starter circuit may conveniently be used with more than one fluorescent lamp—something that is directly in contrast with the ordinary glow-tube starters.

In fact, subject starter circuit may be used with any number of series-connected fluorescent lamps, as long as each of the lamp cathodes are provided with external heating power. And, this external heating power can readily be provided by way of additional secondary windings on the current transformer CT.

In some situations it may be useful to provide a shunt capacitor in parallel with the fluorescent lamp—or, in effect, across the output provided from the ballasting reactor. That way, the magnitude of the source voltage may be reduced since the requisite lamp starting voltage can then be achieved by resonant interaction between this shunt capacitor and the inductance of the ballasting reactor.

Also, with a capacitor across the fluorescent lamp, the power factor of the power provided from the source S can be significantly improved.

It is believed that the present invention and its several attendant advantages and features will be understood from the preceeding description. However, without departing from the spirit of the invention, changes may be made in its form and in the construction and interrelationships of its component parts, the form herein described merely representing the presently preferred embodiment.

I claim:

1. A starter circuit for a fluorescent lamp, said lamp having two cathodes and being adapted to be powered from a source of current-limited voltage, each cathode having a pair of cathode input-terminals, said starter circuit comprising:

non-linear resistive impedance means adapted for connection in circuit between said pairs of cathode input terminals, said impedance means conducting only when the magnitude of the voltage across it is substantially higher than that of the voltage present between said cathodes when the lamp is lit; and power supply means connected in circuit with said non-linear impedance means and operable to provide cathode heating power from separate pairs of cathode output terminals, but only as long as current is flowing through said non-linear impedance means, one of said separate pairs of cathode output terminals being connectable with the cathode input terminals of one of said cathodes, another of said separate pairs of cathode output terminals being connectable with the cathode input terminals of the other one of said cathodes.

2. The starter circuit of claim 1 wherein, when the starter circuit is connected with the lamp, the non-linear impedance means is operative to limit the voltage developed between the two cathodes to a magnitude that is operative to effect controlled lamp starting.

3. The starting circuit of claim 1 wherein, when the starter circuit is connected with the lamp, the power supply is additionally operable to provide lamp starting aid voltage for application to a lamp starting aid electrode.

4. The starter circuit of claim 1 wherein said non-linear impedance means comprises a voltage-limiting semiconductor means.

5. The starter circuit of claim 4 wherein said voltage-limiting semiconductor means is a Varistor.

6. The starter circuit of claim 1 wherein said power supply means comprises a transformer means.

7. The starter circuit of claim 1 wherein circuit protection means is connected with the non-linear impedance means, said circuit protection means being operative to remove power from the non-linear impedance means before it absorbs more energy than it can handle without damage.

8. The starter circuit of claim 1 wherein said current-limited voltage is of a frequency that is substantially higher than those of the voltages normally present on ordinary electric utility power lines.

9. A ballasting arrangement adapted to start and operate a fluorescent lamp from a source of AC voltage, said fluorescent lamp having two cathodes, each cathode having a pair of cathode input terminals, said ballasting arrangement comprising:

reactance means adapted to connect with said source and to provide a manifestly current-limited AC voltage across a pair of main output termianls;

non-linear resistive impedance means connected in circuit across said pair of main output terminals, said impedance means conducting only when the magnitude of the voltage across it is substantially larger than that of the voltage present between said cathodes when the lamp is lit;

power supply means connected in circuit with said non-linear impedance means and operable to provide cathode heating power from separate pairs of cathode output terminals, but only as long as current is flowing through said non-linear impedance means, one of said separate pairs of cathode output terminals being connected with one of said main output terminals, another of said separate pairs of cathode output terminals being connected with the other of said main output terminals; and connect means operative to permit connection of each of said cathode input terminals to one of said separate pairs of cathode output terminals.

10. The ballasting arrangement of claim 9 wherein the non-linear impedance means is operative to limit the voltage developed between said pair of main output terminals to a magnitude that is operative to effect controlled lamp starting.

11. The ballasting arrangement of claim 9 wherein circuit protection means is connected with the non-linear impedance means, said circuit protection means being operative to remove power from the non-linear impedance means before it absorbs more energy that it can handle without damage.

12. A fluorescent lighting system comprising:

source of current-limited AC voltage, said AC voltage being provided across a pair of main output terminals;

fluorescent lamp means having two cathodes, each cathode having two cathode input terminals;

non-linear resistive impedance means connected in circuit across said pair of main output terminals, said impedance means conducting only when the magnitude of the voltage across it is substantially larger than that of the voltage present between said cathodes when the lamp means is lit;

power supply means connected in circuit with said non-linear impedance means and operable to provide cathode power from separate pairs of cathode output terminal, but only as long as current is flowing through said non-linear impedance means, one of said pairs of cathode output terminals being connected with one of the main output terminals, another of said pairs of cathode output terminals being connected with the other of the main output terminals; and connect means operative to effect connection of each of said cathode input terminals with one of said pairs of separate cathode output terminals.

13. The lighting system of claim 12 wherein said source of current-limited AC voltage comprises an inductor means, and where a capacitor means is connected in circuit across said main output terminals.

14. The lighting system of claim 13 wherein there is resonant cooperation between said inductor means and said capacitor means.

15. The lighting system of claim 12 wherein protection means is connected in circuit with the non-linear impedance means, said protection means being operative to remove power from the non-linear impedance means before it absorbs more energy than it can handle without damage.

16. The arrangement comprising:

a gas discharge lamp requiring a certain starting voltage for a brief period of time for proper lamp starting and an operating current for continuous lamp operation thereafter;

a source of power connected with the lamp and operative to supply said operating current, the magnitude of the voltage developing across the lamp before it starts, in the absence of loading means other than the lamp, being substantially larger than that of said certain starting voltage;

loading means effectively connected in parallel with the lamp and operative to cause manifest limitation of the magnitude of the voltage developing thereacross to a level that is not substantially larger than that of said certain starting voltage, said loading means dissipating a substantial degree of power while operative to cause said limitation; and means to substantially reduce the degree of power dissipated in said loading-means if after a brief period of time the lamp does not start, as may occur if the lamp is disconnected or inoperative.

17. The arrangement comprising:

a source of power providing current from a pair of terminals;

a voltage-limiting means effectively connected across said terminals and operative to limit the magnitude of the voltage developing thereacross to a certain level, the voltage-limiting means being conductive only when subjected to a voltage of magnitude about equal to or higher than this certain level;

a gas discharge lamp: (i) being connected across said terminals, (ii) requiring for proper starting to be subjected to a starting voltage for a brief period of time, the magnitude of this starting voltage being equal to or somewhat lower than said certain level, and (iii) after having started, exhibiting an operating voltage that is substantially lower in magnitude than said certain level;

protection means responsive to power dissipation in said voltage-limiting means and operative to substantially reduce this power dissipation in case the lamp should not start within said relatively brief period of time.

* * * * *